US011239559B2

(12) United States Patent
Peng et al.

(10) Patent No.: US 11,239,559 B2
(45) Date of Patent: Feb. 1, 2022

(54) COMMUNICATION DEVICE AND NOTEBOOK COMPUTER DEVICE

(71) Applicant: Wistron NeWeb Corp., Hsinchu (TW)

(72) Inventors: Huang-Tse Peng, Hsinchu (TW); Hsiang-Feng Hsieh, Hsinchu (TW); Wan-Ju Huang, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 45 days.

(21) Appl. No.: 16/595,937

(22) Filed: Oct. 8, 2019

(65) Prior Publication Data

US 2020/0168992 A1 May 28, 2020

(30) Foreign Application Priority Data

Nov. 23, 2018 (TW) ..... 107141861

(51) Int. Cl.

| | |
|---|---|
| ***H01Q 5/371*** | (2015.01) |
| ***H01Q 1/24*** | (2006.01) |
| ***H01Q 5/28*** | (2015.01) |
| ***H01Q 5/328*** | (2015.01) |
| ***H01Q 5/45*** | (2015.01) |
| ***H01Q 9/42*** | (2006.01) |

(52) U.S. Cl.

CPC ..... *H01Q 5/371* (2015.01); *H01Q 1/244* (2013.01); *H01Q 5/28* (2015.01); *H01Q 5/328* (2015.01); *H01Q 5/45* (2015.01); *H01Q 9/42* (2013.01)

(58) Field of Classification Search

CPC ..... H01Q 5/371; H01Q 5/328; H01Q 9/42; H01Q 5/45; H01Q 1/244; H01Q 5/28; H01Q 1/2266; H01Q 5/385; H01Q 5/392

See application file for complete search history.

(56) References Cited

U.S. PATENT DOCUMENTS

| | | | | |
|---|---|---|---|---|
| 8,199,057 | B2 | 6/2012 | Ishizuka et al. | |
| 9,843,092 | B2 * | 12/2017 | Tu | H01Q 13/10 |
| 10,454,156 | B1 * | 10/2019 | Yang | H01Q 5/335 |
| 2010/0265146 | A1 * | 10/2010 | Montgomery | H01Q 1/38 343/722 |
| 2012/0001815 | A1 * | 1/2012 | Wong | H01Q 9/0414 343/749 |
| 2012/0075156 | A1 | 3/2012 | Noguchi et al. | |
| 2017/0352945 | A1 * | 12/2017 | Chang | H01Q 1/36 |
| 2018/0183147 | A1 | 6/2018 | Ku et al. | |

FOREIGN PATENT DOCUMENTS

| | | |
|---|---|---|
| CN | 101496224 A | 7/2009 |
| TW | M545375 U | 7/2017 |

* cited by examiner

*Primary Examiner* — Dimary S Lopez Cruz

*Assistant Examiner* — Michael M Bouizza

(74) *Attorney, Agent, or Firm* — McClure, Qualey & Rodack, LLP

(57) ABSTRACT

A communication device includes a ground element, an antenna structure, a first reflector, a second reflector, a first tuning element, and a switch element. The first reflector is disposed adjacent to the antenna structure. The second reflector is disposed adjacent to the antenna structure. The second reflector is separate from the first reflector. The switch element is coupled to the first tuning element. When the switch element is enabled, the switch element couples the first tuning element to the first reflector or the second reflector. When the switch element is disabled, the first tuning element is separate from the first reflector and the second reflector.

19 Claims, 6 Drawing Sheets

COMMUNICATION DEVICE AND NOTEBOOK COMPUTER DEVICE

CROSS REFERENCE TO RELATED APPLICATIONS

This application claims priority of Taiwan Patent Application No. 107141861 filed on Nov. 23, 2018, the entirety of which is incorporated by reference herein.

BACKGROUND OF THE INVENTION

Field of the Invention

The disclosure generally relates to a communication device, and more particularly, it relates to a communication device and an antenna structure therein.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

An antenna is indispensable in a mobile device supporting wireless communication. However, the radiation pattern of the antenna is often fixed and has some nulls, which may degrade the communication quality of the antenna in specific directions. Accordingly, there is a need to propose a novel solution for solving the problems of the prior art.

BRIEF SUMMARY OF THE INVENTION

In an exemplary embodiment, the disclosure is directed to a communication device including a ground element, an antenna structure, a first reflector, a second reflector, a first tuning element, and a switch element. The first reflector is disposed adjacent to the antenna structure. The second reflector is disposed adjacent to the antenna structure. The second reflector is separate from the first reflector. The switch element is coupled to the first tuning element. When the switch element is enabled, the switch element couples the first tuning element to the first reflector or the second reflector. When the switch element is disabled, the first tuning element is separate from the first reflector and the second reflector.

In some embodiments, the first reflector has a substantially inverted L-shape.

In some embodiments, the second reflector has a substantially straight-line shape.

In some embodiments, the combination of the first reflector and the second reflector has a substantially U-shape, and the antenna structure is positioned in a notch region of the U-shape.

In some embodiments, the communication device further includes a second tuning element coupled to a bending portion of the first reflector.

In some embodiments, each of the first tuning element and the second tuning element has a substantially straight-line shape.

In some embodiments, the antenna structure covers a first frequency band from 2400 MHz to 2500 MHz, and a second frequency band from 5150 MHz to 5850 MHz.

In some embodiments, the length of the first reflector is longer than ½ wavelength of the second frequency band.

In some embodiments, the length of the second reflector is longer than ½ wavelength of the second frequency band.

In some embodiments, the length of the first reflector is longer than the length of the second reflector.

In some embodiments, the distance between the first reflector and the antenna structure is from 1/16 to ¼ wavelength of the second frequency band.

In some embodiments, the distance between the second reflector and the antenna structure is from 1/16 to ¼ wavelength of the second frequency band.

In some embodiments, the antenna structure includes a feeding radiation element, a first radiation element, a second radiation element, and a shorting element. The feeding radiation element is coupled to a signal source. The first radiation element is coupled to the feeding radiation element. The second radiation element is coupled to the feeding radiation element. The feeding radiation element is coupled through the shorting element to the ground element.

In some embodiments, the feeding radiation element has a substantially straight-line shape.

In some embodiments, the first radiation element has a substantially C-shape, and the second radiation element has a substantially rectangular shape.

In another exemplary embodiment, the invention is directed to a communication device including a ground element, an antenna structure, a first reflector, and a second reflector. The first reflector is disposed adjacent to the antenna structure. The second reflector is disposed adjacent to the antenna structure. The second reflector is separate from the first reflector. The first reflector is partially parallel to the second reflector. A virtual extension line of the first reflector is perpendicular to a virtual extension line of the second reflector. The combination of the first reflector and the second reflector has a substantially U-shape. The antenna structure is positioned in a notch region of the U-shape.

In some embodiments, the first reflector has a substantially inverted L-shape, and the second reflector has a substantially straight-line shape.

In some embodiments, the communication device further includes a first tuning element and a switch element. A notch is formed between the first reflector and the second reflector. The first tuning element is adjacent to the notch, and is coupled to the switch element. When the switch element is enabled, the switch element couples the first tuning element to the first reflector or the second reflector. When the switch element is disabled, the first tuning element is separate from the first reflector and the second reflector.

In another exemplary embodiment, the disclosure is directed to a notebook computer device including a cover element, a hinge element, a body element, and a communication device. The hinge element is connected to the cover element. The body element is connected to the cover element by the hinge element. The communication device is disposed in the notebook computer device. The communication device includes a ground element, an antenna structure, a first reflector, a second reflector, a first tuning element, and a switch element. The first reflector is disposed adjacent to the antenna structure. The second reflector is disposed adjacent to the antenna structure. The second reflector is separate from the first reflector. When the switch element is enabled, the switch element couples the first tuning element to the first reflector or the second reflector. When the switch element is disabled, the first tuning element is separate from the first reflector and the second reflector.

In some embodiments, the first reflector has a substantially inverted L-shape, the second reflector has a substantially straight-line shape, the combination of the first reflector and the second reflector has a substantially U-shape, and the communication device is positioned in a notch region of the U-shape.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1:
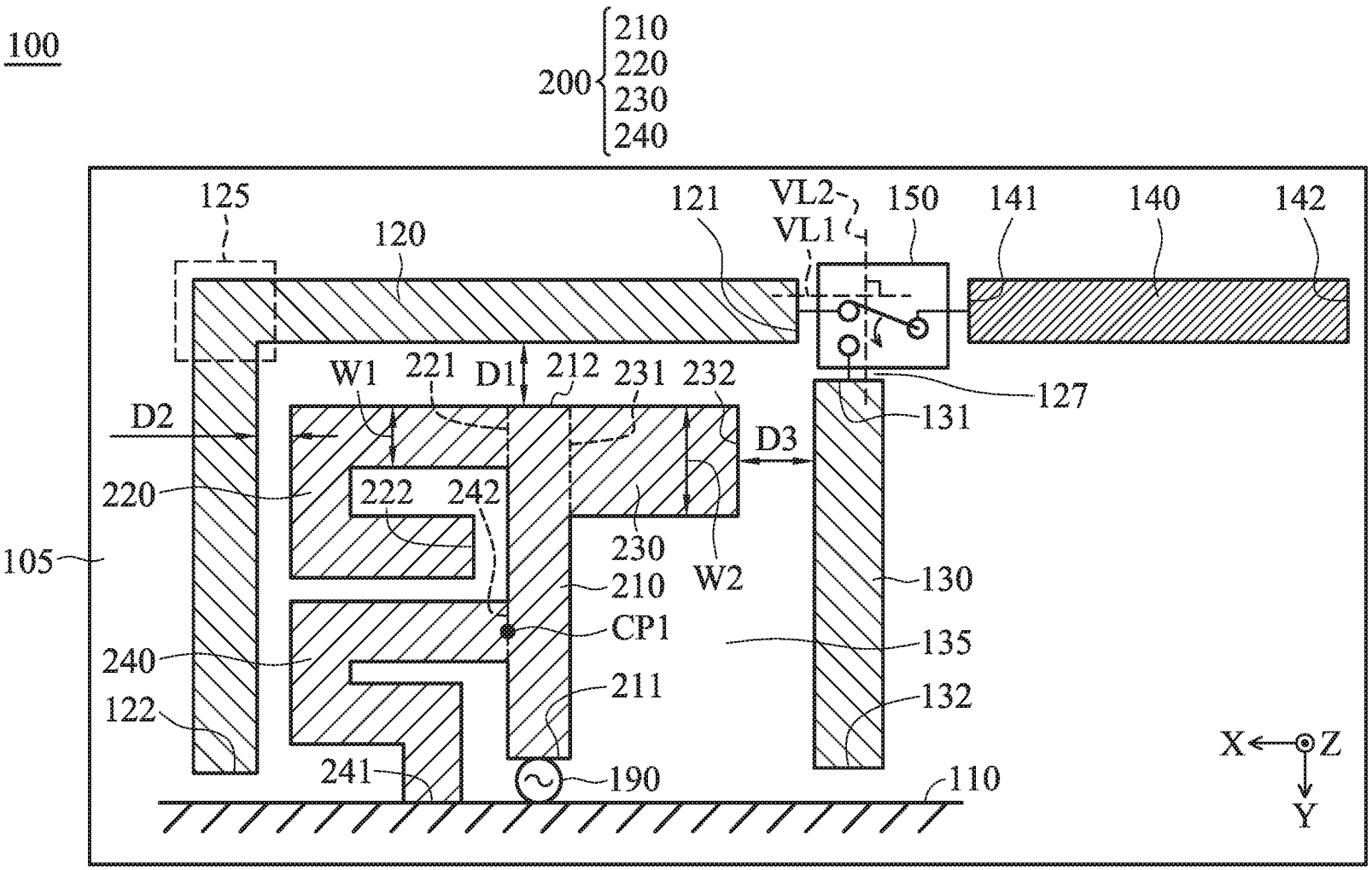
FIG. 1 is a diagram of a communication device according to an embodiment of the invention.

FIG. 1 is a diagram of a communication device 100 according to an embodiment of the invention. In the embodiment of FIG. 1, the communication device 100 includes a ground element 110, an antenna structure 200, a first reflector 120, a second reflector 130, a first tuning element 140, and a switch element 150. The ground element 110, the antenna structure 200, the first reflector 120, the second reflector 130, and the first tuning element 140 may be made of metal materials, such as copper, silver, aluminum, iron, or their alloys. The communication device 100 may be formed on a carrier 105. The carrier 105 may be made of a nonconductive material, and it may be a plane carrier, a curved carrier, or a 3D (Three-Dimensional) carrier (e.g., a cuboid carrier or a cylindrical carrier).

The ground element 110 may be a ground copper foil, which may be coupled to a system ground plane (not shown). The system ground plane provides a ground voltage. The shape and type of the antenna structure 200 are not limited in the invention. For example, the antenna structure 200 may be a monopole antenna, a dipole antenna, a PIFA (Planar Inverted F Antenna), a helical antenna, a patch antenna, or a chip antenna, but it is not limited thereto.

In the embodiment of FIG. 1, the antenna structure 200 includes a feeding radiation element 210, a first radiation element 220, a second radiation element 230, and a shorting element 240. The feeding radiation element 210 may substantially have a straight-line shape. The feeding radiation element 210 has a first end 211 and a second end 212. The first end 211 of the feeding radiation element 210 is coupled to a signal source 190. For example, the signal source 190 may be an RF (Radio Frequency) module for exciting the antenna structure 200. The feeding radiation element 210 is positioned between the first radiation element 220 and the second radiation element 230. For example, the first radiation element 220 and the shorting element 240 may be positioned at the left side of the feeding radiation element 210, and the second radiation element 230 may be positioned at the right side of the feeding radiation element 210. The first radiation element 220 may substantially have a C-shape. The first radiation element 220 has a first end 221 and a second end 222. The first end 221 of the first radiation element 220 is coupled to the second end 212 of the feeding radiation element 210. The second end 222 of the first radiation element 220 is an open end, which extends toward the feeding radiation element 210. The second radiation element 230 may substantially have a rectangular shape. The second radiation element 230 has a first end 231 and a second end 232. The first end 231 of the second radiation element 230 is coupled to the second end 212 of the feeding radiation element 210. The second end 232 of the second radiation element is an open end, which extends away from the feeding radiation element 210. The shorting element 240 may be substantially a C-shape or an S-shape. The shorting element 240 has a first end 241 and a second end 242. The first end 241 of the shorting element 240 is coupled to the ground element 110, and the second end 242 of the shorting element 240 is coupled to a connection point CP1 on the feeding radiation element 210 (the connection point CP1 is positioned between the first end 211 and the second end 212 of the feeding radiation element 210), such that the feeding radiation element 210 is coupled through the shorting element 240 to the ground element 110.

In some embodiments, the antenna structure 200 covers a first frequency band from 2400 MHz to 2500 MHz, and a second frequency band from 5150 MHz to 5850 MHz. With respect to the antenna theory, the feeding radiation element 210 and the first radiation element 220 are excited to generate the first frequency band. The feeding radiation element 210 and the second radiation element 230 are excited to generate the second frequency band. The shorting element 240 is configured to fine-tune the impedance matching of the antenna structure 200. The width W2 of the second radiation element 230 may be greater than the width W1 of the first radiation element 220, so as to increase the operation bandwidth of the second frequency band. Accordingly, the antenna structure 200 can support at least the dual-band operations of WLAN (Wireless Local Area Networks) 2.4 GHz/5 GHz.

The first reflector 120 may substantially have an inverted L-shape. The first reflector 120 has a first end 121 and a second end 122. The second end 122 of the first reflector 120 is an open end, which is adjacent to the ground element 110. The second reflector 130 may substantially have a straight-line shape. The second reflector 130 has a first end 131 and a second end 132. The first end 131 of the second reflector 130 is adjacent to the first end 121 of the first reflector 120. The second end 132 of the second reflector 130 is an open end, which is adjacent to the ground element 110. The first reflector 120 may be partially perpendicular to the second reflector 130, and the first reflector 120 may be partially parallel to the second reflector 130. For example, a virtual extension line VL1 of the first reflector 120 may be perpendicular to a virtual extension line VL2 of the second reflector 130. Specifically, the combination of the first reflector 120 and the second reflector 130 may substantially have a U-shape. The antenna structure 200 may be positioned in a notch region 135 of the U-shape. The first tuning element 140 may substantially have a straight-line shape, which may be substantially perpendicular to the second reflector 130. The first tuning element 140 has a first end 141 and a second end 142. The first end 141 of the first tuning element 140 is adjacent to the first end 121 of the first reflector 120 and the first end 131 of the second reflector 130. The second end 142 of the first tuning element 140 is an open end, which extends away from the first reflector 120. Specifically, a notch 127 is formed between the first reflector 120 and the second reflector 130. The first end 141 of the first tuning element 140 is adjacent to the notch 127 and is coupled to the switch element 150. In alternative embodiments, the position of the first tuning element 140 is adjustable according to different requirements, and it is not necessarily perpendicular to the second reflector 130.

The first reflector 120, the second reflector 130, and the first tuning element 140 may all be floating. The first reflector 120, the second reflector 130, and the antenna structure 200 may be completely separate from each other. Both the first reflector 120 and the second reflector 130 are disposed adjacent to the antenna structure 200, so as to control and adjust the radiation pattern of the antenna structure 200. The first tuning element 140 is configured to fine-tune the effective length of the first reflector 120 or the second reflector 130. It should be noted that the term "adjacent" or "close" over the disclosure means that the distance (spacing) between two corresponding elements is smaller than a predetermined distance (e.g., 5 mm or the shorter), but does not mean that the two corresponding elements directly touch each other (i.e., the aforementioned distance/spacing therebetween is reduced to 0).

The switch element 150 may be implemented with an IC (Integrated Circuit) element. For example, the switch element 150 may be an SPDT (Single Pole Double Throw) switch, but it is not limited thereto. The switch element 150 is coupled to the first end 141 of the first tuning element 140. The switch element 150 is selectively enabled or disabled according to a control signal, and its switching state is also determined according to the control signal. For example, the aforementioned control signal may be generated by a processor according to a user input or an antenna measurement result. When the switch element 150 is enabled, the switch element 150 couples the first end 141 of the first tuning element 140 to either the first end 121 of the first reflector 120 or the first end 131 of the second reflector 130, such that the effective length of the corresponding one of the first reflector 120 and the second reflector 130 is increased. When the switch element 150 is disabled, the switch element 150 operates in an open-circuited state, and the first tuning element 140 is completely separate from the first reflector 120 and the second reflector 130, such that the effective lengths of the first reflector 120 and the second reflector 130 are both maintained.

In some embodiments, the element sizes of the communication device 100 are described as follows. The length of the first reflector 120 (i.e., the length from the first end 121 to the second end 122) may be longer than ½ wavelength (λ/2) of the second frequency band. The length of the second reflector 130 (i.e., the length from the first end 131 to the second end 132) may be longer than ½ wavelength (λ/2) of the second frequency band. The length of the first reflector 120 may be longer than the length of the second reflector 130. For example, the length of the first reflector 120 may be substantially 2 times the length of the second reflector 130. The distance D1 or D2 between the first reflector 120 and the antenna structure 200 may be from 1/16 to ¼ wavelength (λ/16~λ/4) of the second frequency band (e.g., ⅛ wavelength). The distance D3 between the second reflector 130 and the antenna structure 200 may be from 1/16 to ¼ wavelength (λ/16~λ/4) of the second frequency band (e.g., ⅛ wavelength). The length of the first tuning element 140 (i.e., the length from the first end 141 to the second end 142) may be substantially equal to ¼ wavelength (λ/4) of the second frequency band. The total length of the feeding radiation element 210 and the first radiation element 220 (i.e., the total length from the first end 211 through the first end 221 to the second end 222) may be substantially equal to ¼ wavelength (λ/4) of the first frequency band. The total length of the feeding radiation element 210 and the second radiation element 230 (i.e., the total length from the first end 211 through the first end 231 to the second end 232) may be substantially equal to ¼ wavelength (λ/4) of the second frequency band. In some embodiments, the width W2 of the second radiation element 230 may be substantially 2 times the width W1 of the first radiation element 220. The above ranges of element sizes are calculated and obtained according to many experiment results, and they help to optimize the operation bandwidth and impedance matching of the communication device 100.

Figure 2:
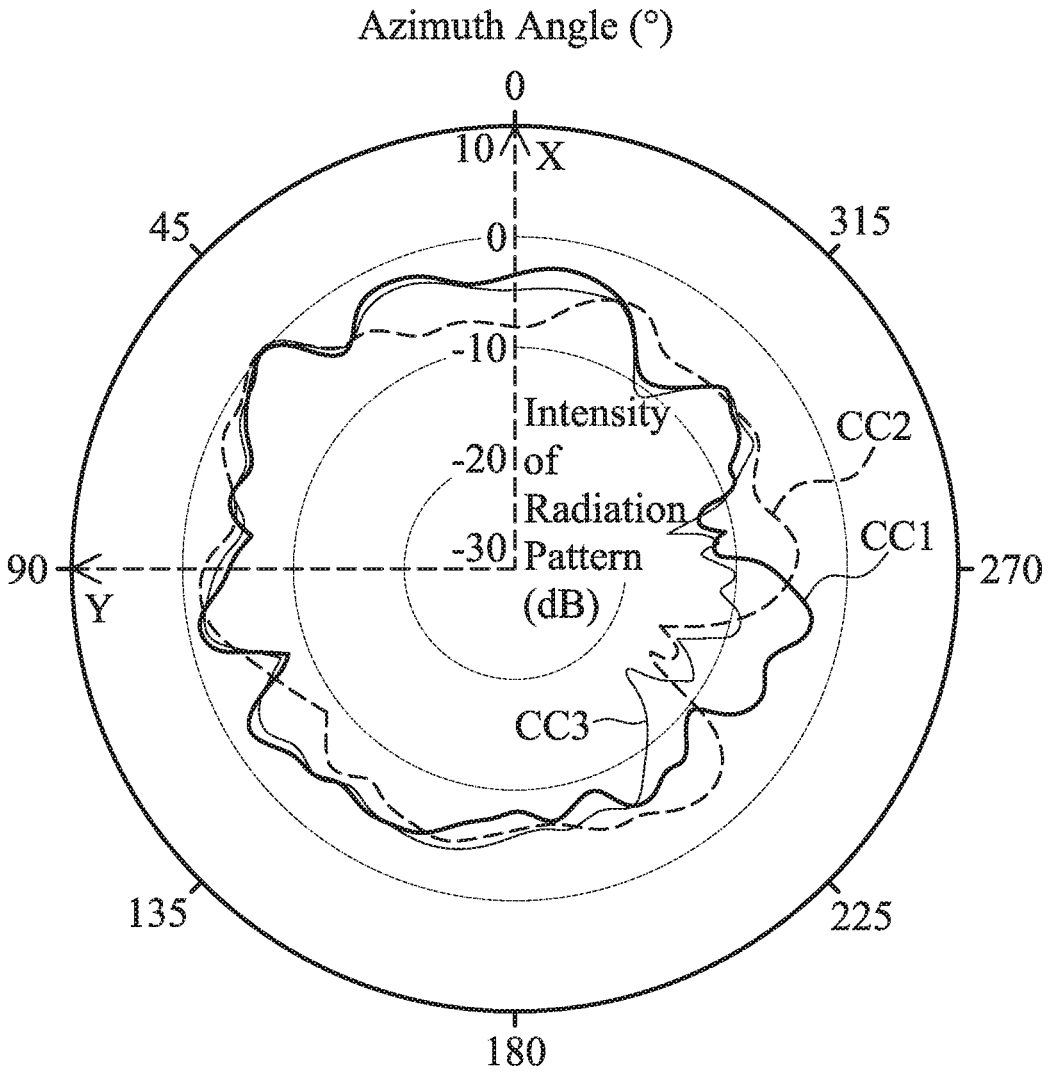
FIG. 2 is a diagram of a radiation pattern of an antenna structure of a communication device according to an embodiment of the invention.

FIG. 2 is a diagram of a radiation pattern of the antenna structure 200 of the communication device 100 according to an embodiment of the invention. A first curve CC1 represents the radiation pattern of the antenna structure 200 when the switch element 150 is enabled and the first tuning element 140 is coupled to the first reflector 120 (i.e., a first operation mode). A second curve CC2 represents the radiation pattern of the antenna structure 200 when the switch element 150 is enabled and the first tuning element 140 is coupled to the second reflector 130 (i.e., a second operation mode). A third curve CC3 represents the radiation pattern of the antenna structure 200 when the switch element 150 is disabled and the first tuning element 140 is neither coupled to the first reflector 120 nor coupled to the second reflector 130 (i.e., a third operation mode). According to the measurement of FIG. 2, by appropriately controlling the switch element 150 and selectively changing the effective length of the first reflector 120 or the second reflector 130, a user can effectively modify the radiation pattern of the antenna structure 200 and eliminate the nulls thereof. With such a design, the radiation pattern of the antenna structure 200 can be dynamically adjusted according to different requirements, thereby significantly improving the whole communication quality of the communication device 100.

In some embodiments, the communication device 100 further includes a processor, a detector, and a GPIO (General-Purpose Input/Output) interface (not shown). The switch element 150 can switch to different radiation patterns (or different operation modes) one after another. The detector is coupled to the antenna structure 200, and is configured to monitor the RSSI (Received Signal Strength Indicator) corresponding to each radiation pattern (or each operation mode). The processor compares all of the RSSIs with each other, so as to generate a control signal. The control signal is transmitted through the GPIO interface to the switch element 150. Then, the processor can control the switch element 150 to select the operation mode and radiation pattern corresponding to the largest RSSI, thereby optimizing the communication quality of the communication device 100.

Figure 3:
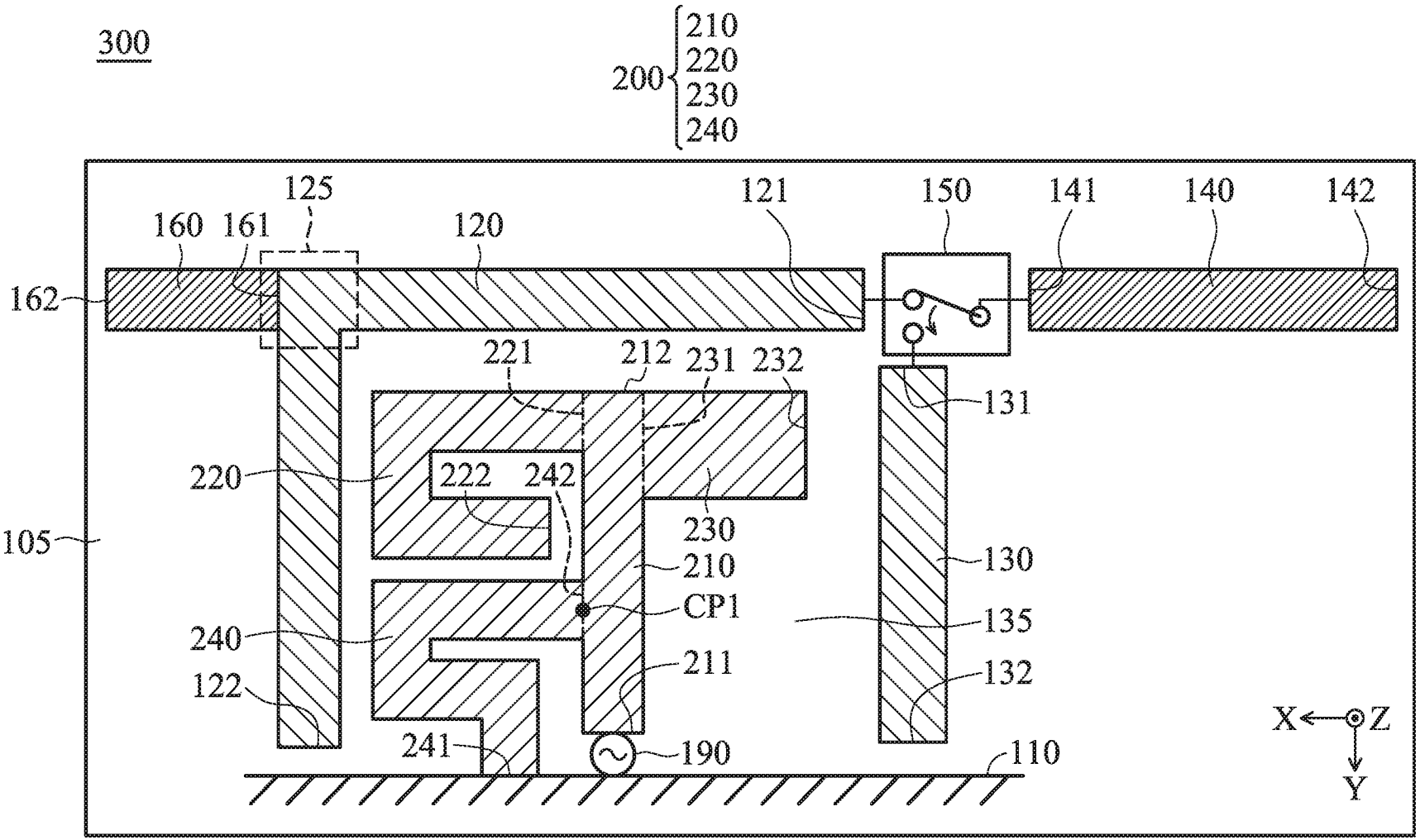
FIG. 3 is a diagram of a communication device according to another embodiment of the invention.

FIG. 3 is a diagram of a communication device 300 according to another embodiment of the invention. FIG. 3 is similar to FIG. 1. In the embodiment of FIG. 3, the communication device 300 further includes a second tuning element 160, which is made of a metal material. The second tuning element 160 may substantially have a straight-line shape. The second tuning element 160 has a first end 161 and a second end 162. The first end 161 of the second tuning element 160 is coupled to a bending portion 125 of the first reflector 120. The second end 162 of the second tuning element 160 is an open end, which extends away from the first reflector 120. Furthermore, the second end 162 of the second tuning element 160 and the second end 142 of the first tuning element 140 may extend in opposite directions. The length of the second tuning element 160 (i.e., the length from the first end 161 to the second end 162) may be shorter than ¼ wavelength (λ/4) of the second frequency band. According to practical measurements, the incorporation of the second tuning element 160 helps to improve the impedance matching of the first reflector 120. Other features of the communication device 300 of FIG. 3 are similar to those of the communication device 100 of FIG. 1. Therefore, the two embodiments can achieve similar levels of performances.

Figure 4:
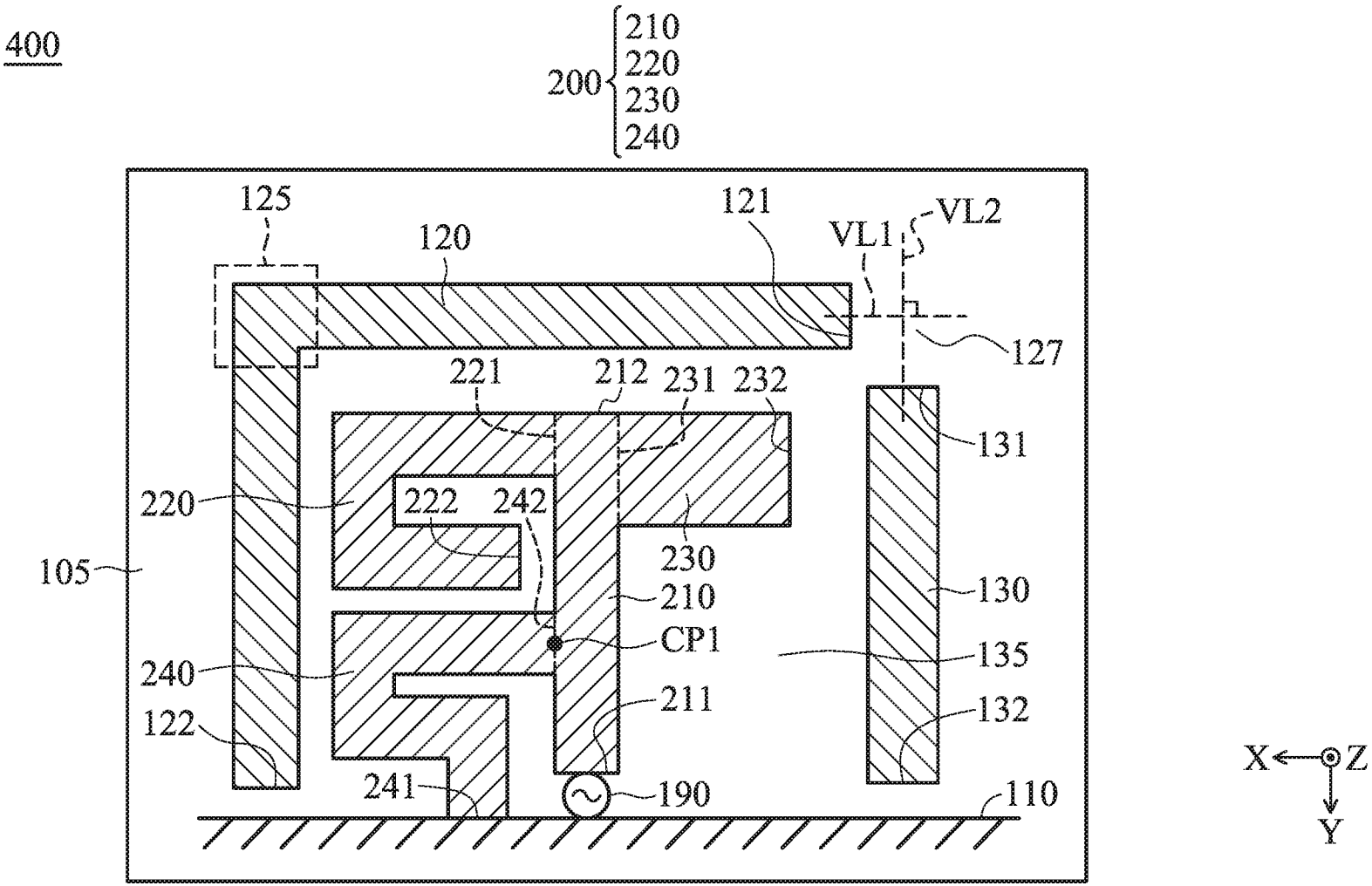
FIG. 4 is a diagram of a communication device according to another embodiment of the invention.

FIG. 4 is a diagram of a communication device 400 according to another embodiment of the invention. FIG. 4 is similar to FIG. 1. In the embodiment of FIG. 4, the communication device 400 does not include the first tuning element 140 and the switch element 150. However, by appropriately designing the positions of the first reflector 120 and the second reflector 130, the nulls of the radiation pattern of the antenna structure 200 can be still modified and eliminated. The communication device 400 without using the first tuning element 140 and the switch element 150 has a lower manufacturing cost. Other features of the communication device 400 of FIG. 4 are similar to those of the communication device 100 of FIG. 1. Therefore, the two embodiments can achieve similar levels of performances.

Figure 5:
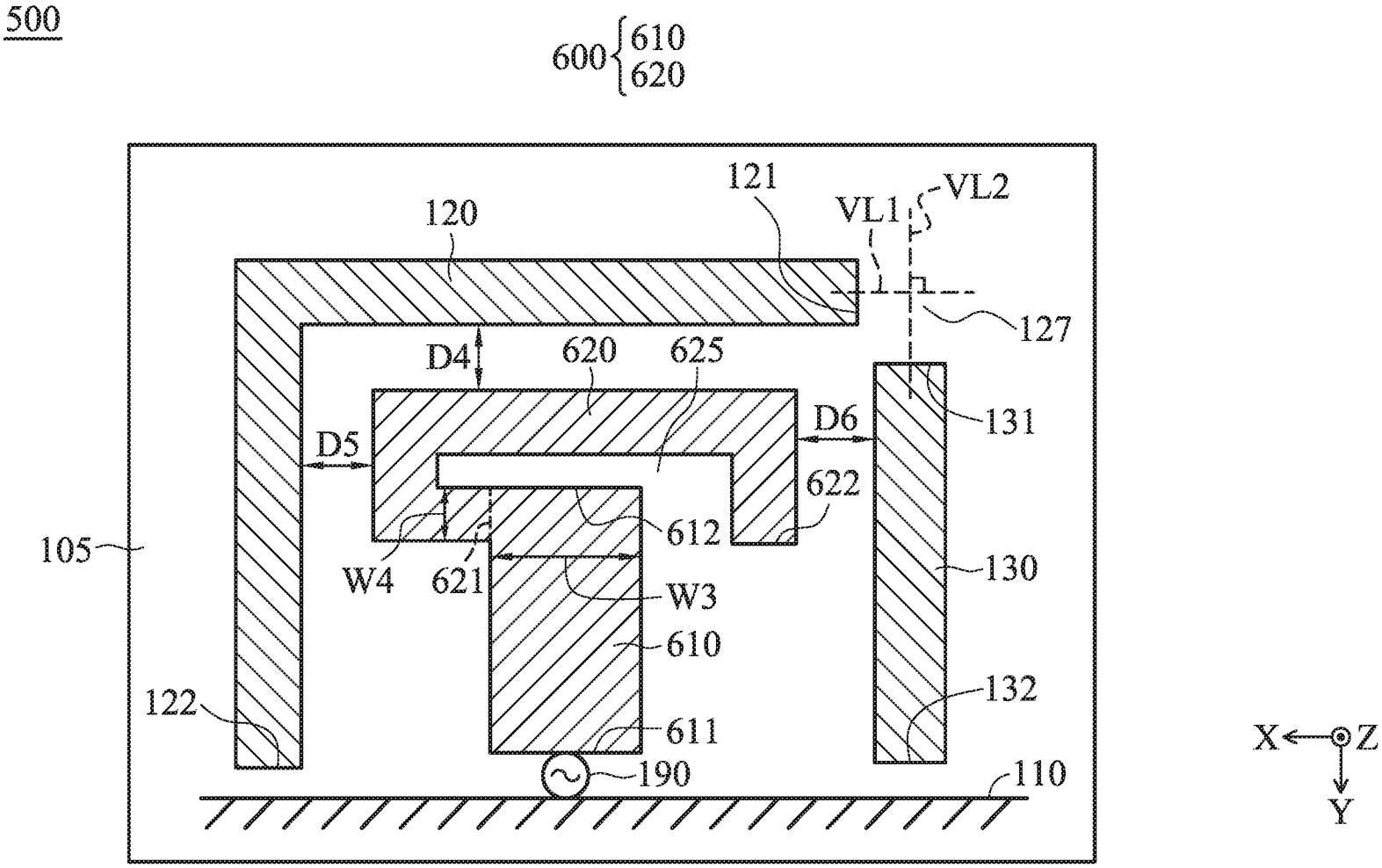
FIG. 5 is a diagram of a communication device according to another embodiment of the invention.

FIG. 5 is a diagram of a communication device 500 according to another embodiment of the invention. FIG. 5 is similar to FIG. 4. In the embodiment of FIG. 5, an antenna structure 600 of the communication device 500 has a different configuration. Specifically, the antenna structure 600 includes a feeding radiation element 610 and a first radiation element 620. The feeding radiation element 610 may substantially have a rectangular shape. The feeding radiation element 610 has a first end 611 and a second end 612. The first end 611 of the feeding radiation element 610 is coupled to the signal source 190. The first radiation element 620 may substantially have an inverted C-shape. The second end 612 of the feeding radiation element 610 may be positioned in a notch region 625 of the inverted C-shape. The first radiation element 620 has a first end 621 and a second end 622. The first end 621 of the first radiation element 620 is coupled to the second end 612 of the feeding radiation element 610. The second end 622 of the first radiation element 620 is an open end, which extends toward the ground element 110. According to practical measurement, the antenna structure 600 also covers a first frequency band from 2400 MHz to 2500 MHz, and a second frequency band from 5150 MHz to 5850 MHz. With respect to the antenna theory, the feeding radiation element 610 and the first radiation element 620 are excited to generate the first frequency band. The feeding radiation element 610 is excited to generate the second frequency band. The distance D4 or D5 between the first reflector 120 and the antenna structure 600 may be from 1/16 to ¼ wavelength (λ/16~λ/4) of the second frequency band (e.g., ⅛ wavelength). The distance D6 between the second reflector 130 and the antenna structure 600 may be from 1/16 to ¼ wavelength (λ/16~λ/4) of the second frequency band (e.g., ⅛ wavelength). The total length of the feeding radiation element 610 and the first radiation element 620 (i.e., the total length from the first end 611 through the first end 621 to the second end 622) may be substantially equal to ¼ wavelength (λ/4) of the first frequency band. The length of the feeding radiation element 610 (i.e., the length from the first end 611 to the second end 612) may be substantially equal to ¼ wavelength (λ/4) of the second frequency band. The width W3 of the feeding radiation element 610 is greater than the width W4 of the first radiation element 620, so as to increase the operation bandwidth of the second frequency band. For example, in some embodiments, the width W3 of the feeding radiation element 610 is substantially 3 times the width W4 of the first radiation element 620. Other features of the communication device 500 of FIG. 5 are similar to those of the communication device 400 of FIG. 4. Therefore, the two embodiments can achieve similar levels of performances.

In alternative embodiments, the antenna structure 600 of FIG. 5 may be applied to the communication device 100 of FIG. 1, such that the antenna structure 200 of the communication device 100 is replaced with the antenna structure 600 of FIG. 5, without affecting the performance of the invention.

Figure 6:
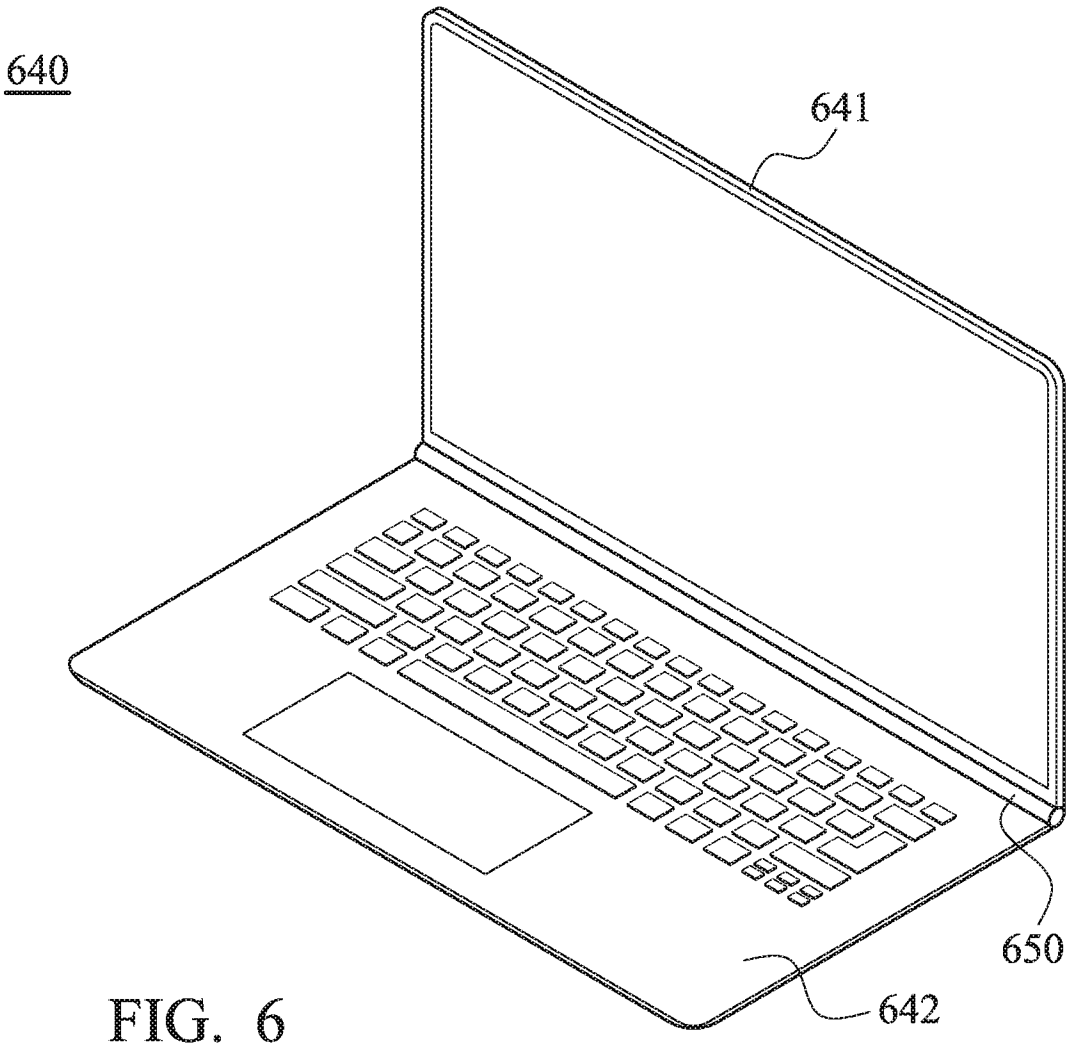
FIG. 6 is a diagram of a mobile device according to an embodiment of the invention.

FIG. 6 is a diagram of a notebook computer device 640 according to an embodiment of the invention. In the embodiment of FIG. 6, the proposed communication device is disposed in the notebook computer device 640. The notebook computer device 640 may include a cover element 641, a body element 642, and a hinge element 650. The hinge element 650 is connected to the cover element 641. The body element 642 is connected to the cover element 641 by the hinge element 650. The notebook computer device 640 further includes the aforementioned communication device. The aforementioned communication device and its reflectors and antenna structure may be positioned at the hinge element 650, so as to modify the antenna radiation pattern and improve the communication quality of the notebook computer device 640. In alternative embodiments, the notebook computer device 640 is replaced with a smartphone or a tablet computer, but it is not limited thereto.

The invention proposes a novel communication device. By adding two independent reflectors around a fixed antenna structure, the radiation pattern of the antenna structure is effectively modified, and the nulls of the radiation pattern structure are eliminated. Furthermore, the communication device may selectively use a switch element and a tuning element to change the resonant lengths of the reflectors and to provide different operation modes. In comparison to the conventional design, the invention has at least the advantages of minimizing the size, reducing the manufacturing cost, and maintaining the antenna communication quality, and therefore it is suitable for application in a variety of communication devices.

Note that the above element sizes, element shapes, and frequency ranges are not limitations of the invention. An antenna designer can fine-tune these settings or values according to different requirements. It should be understood that the communication device of the invention is not limited to the configurations of FIGS. 1-6. The invention may merely include any one or more features of any one or more embodiments of FIGS. 1-6. In other words, not all of the features displayed in the figures should be implemented in the communication device of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A communication device, comprising:
- a ground element;
- an antenna structure;
- a first reflector, disposed adjacent to the antenna structure;
- a second reflector, disposed adjacent to the antenna structure, wherein the second reflector is separate from the first reflector;
- a first tuning element; and
- a switch element, coupled to the first tuning element, wherein when the switch element is enabled, the switch element couples the first tuning element to the first reflector or the second reflector, and when the switch element is disabled, the first tuning element is separate from the first reflector and the second reflector;
- wherein the antenna structure covers a first frequency band and a second frequency band, and wherein the second frequency band is different from the first frequency band;
- wherein the length of the first reflector is substantially 2 times the length of the second reflector.

2. The communication device as claimed in claim 1, wherein the first reflector substantially has an inverted L-shape.

3. The communication device as claimed in claim 1, wherein the second reflector substantially has a straight-line shape.

4. The communication device as claimed in claim 1, wherein a combination of the first reflector and the second reflector substantially has a U-shape, and the antenna structure is positioned in a notch region of the U-shape.

5. The communication device as claimed in claim 1, further comprising:
- a second tuning element, coupled to a bending portion of the first reflector.

6. The communication device as claimed in claim 5, wherein each of the first tuning element and the second tuning element substantially has a straight-line shape.

7. The communication device as claimed in claim 1, wherein the first frequency band is from 2400 MHz to 2500 MHz, and the second frequency band is from 5150 MHz to 5850 MHz.

8. The communication device as claimed in claim 7, wherein a length of the first reflector is longer than ½ wavelength of the second frequency band.

9. The communication device as claimed in claim 7, wherein a length of the second reflector is longer than ½ wavelength of the second frequency band.

10. The communication device as claimed in claim 7, wherein a distance between the first reflector and the antenna structure is from 1/16 to ¼ wavelength of the second frequency band.

11. The communication device as claimed in claim 7, wherein a distance between the second reflector and the antenna structure is from 1/16 to ¼ wavelength of the second frequency band.

12. The communication device as claimed in claim 1, wherein the antenna structure comprises:
- a feeding radiation element, coupled to a signal source;
- a first radiation element, coupled to the feeding radiation element;
- a second radiation element, coupled to the feeding radiation element; and
- a shorting element, wherein the feeding radiation element is coupled through the shorting element to the ground element.

13. The communication device as claimed in claim 12, wherein the feeding radiation element substantially has a straight-line shape.

14. The communication device as claimed in claim 12, wherein the first radiation element substantially has a C-shape, and the second radiation element substantially has a rectangular shape.

15. A communication device, comprising:
- a ground element;
- an antenna structure;
- a first reflector, disposed adjacent to the antenna structure;
- a second reflector, disposed adjacent to the antenna structure, wherein the second reflector is separate from the first reflector;
- wherein the first reflector is partially parallel to the second reflector, a virtual extension line of the first reflector is perpendicular to a virtual extension line of the second reflector, a combination of the first reflector and the second reflector substantially has a U-shape, and the antenna structure is positioned in a notch region of the U-shape;
- wherein the antenna structure covers a first frequency band and a second frequency band, and wherein the second frequency band is different from the first frequency band;
- wherein the length of the first reflector is substantially 2 times the length of the second reflector.

16. The communication device as claimed in claim 15, wherein the first reflector substantially has an inverted L-shape, and the second reflector substantially has a straight-line shape.

17. The communication device as claimed in claim 16, further comprising:
- a first tuning element; and
- a switch element, wherein a notch is formed between the first reflector and the second reflector, and the first tuning element is adjacent to the notch and is coupled to the switch element, and wherein when the switch element is enabled, the switch element couples the first tuning element to the first reflector or the second reflector, and when the switch element is disabled, the first tuning element is separate from the first reflector and the second reflector.

18. A notebook computer device, comprising:

a cover element;

a hinge element, connected to the cover element;

a body element, connected to the cover element by the hinge element; and a communication device, disposed in the notebook computer device, wherein the communication device comprises:

a ground element;

an antenna structure;

a first reflector, disposed adjacent to the antenna structure;

a second reflector, disposed adjacent to the antenna structure, wherein the second reflector is separate from the first reflector;

a first tuning element; and a switch element, wherein when the switch element is enabled, the switch element couples the first tuning element to the first reflector or the second reflector, and when the switch element is disabled, the first tuning element is separate from the first reflector and the second reflector;

wherein the antenna structure covers a first frequency band and a second frequency band, and wherein the second frequency band is different from the first frequency band;

wherein the length of the first reflector is substantially 2 times the length of the second reflector.

19. The notebook computer device as claimed in claim 18, wherein the first reflector substantially has an inverted L-shape, the second reflector substantially has a straight-line shape, a combination of the first reflector and the second reflector substantially has a U-shape, and the communication device is positioned in a notch region of the U-shape.

* * * * *